US005348571A

United States Patent [19]

Weber

[11] Patent Number: 5,348,571

[45] Date of Patent: Sep. 20, 1994

[54] APPARATUS FOR DEDUSTING A GAS AT HIGH TEMPERATURE

[75] Inventor: Ekkehard Weber, Essen, Fed. Rep. of Germany

[73] Assignee: Metallgesellschaft Aktiengesellschaft, Frankfurt am Main, Fed. Rep. of Germany

[21] Appl. No.: 1,791

[22] Filed: Jan. 8, 1993

[30] Foreign Application Priority Data

Jan. 9, 1992 [DE] Fed. Rep. of Germany ..... 4200343

[51] Int. Cl.[5] ..... B03C 3/08; B03C 3/47; B03C 3/49; B03C 3/62

[52] U.S. Cl. ..... 96/68; 55/523; 55/524; 55/DIG. 38; 95/78; 96/87; 96/95; 96/98

[58] Field of Search ..... 96/98, 99, 66, 95, 65, 96/96, 87, 68; 95/57, 78; 55/523, 524, DIG. 38; 361/226, 233, 225, 230

[56] References Cited

U.S. PATENT DOCUMENTS

| | | | |
|---|---|---|---|
| 3,513,635 | 5/1970 | Eishold et al. | 96/99 |
| 3,763,632 | 10/1973 | Imris | 96/95 |
| 4,010,011 | 3/1977 | Reif | 96/99 X |
| 4,077,782 | 3/1978 | Drummond et al. | 96/99 X |
| 4,077,785 | 3/1978 | Hartshorn | 96/99 |
| 4,185,972 | 1/1980 | Nitta et al. | 96/99 |
| 4,216,000 | 8/1980 | Kofoid | 96/99 X |
| 4,251,239 | 2/1981 | Clyde et al. | 96/67 |
| 4,357,151 | 11/1982 | Helfritch et al. | 96/99 X |
| 4,477,268 | 10/1984 | Kalt | 96/99 |
| 5,084,078 | 1/1992 | Suzuki et al. | 96/99 X |
| 5,137,546 | 8/1992 | Steinbacher et al. | 96/98 X |

FOREIGN PATENT DOCUMENTS

| | | | |
|---|---|---|---|
| 215121 | 2/1957 | Australia | 96/99 |
| 230330 | 4/1960 | Australia | 96/99 |
| 314030 | 8/1919 | Fed. Rep. of Germany . | |
| 490398 | 1/1930 | Fed. Rep. of Germany . | |
| 963868 | 5/1957 | Fed. Rep. of Germany . | |
| 1407023 | 10/1968 | Fed. Rep. of Germany . | |
| 1557148 | 5/1970 | Fed. Rep. of Germany . | |
| 2851433 | 6/1979 | Fed. Rep. of Germany . | |
| 50-9368 | 1/1975 | Japan | 96/99 |
| 52-60475 | 5/1977 | Japan | 96/99 |
| 739628 | 2/1955 | United Kingdom . | |
| 883876 | 12/1961 | United Kingdom | 96/99 |

OTHER PUBLICATIONS

R. Pitt, "Heissgasentstaubung", in Sonderlösungen der Lufteinhaltung, Mar. 1989, pp. L4 to L7.

Ullmann's "Encyklopädie der technischen Chemie", 4th Edition, vol. 2, pp. 240–247, Feb., 1973.

*Primary Examiner*—Richard L. Chiesa

*Attorney, Agent, or Firm*—Michael J. Striker

[57] ABSTRACT

The apparatus for dedusting a gas by electrostatic precipitation includes an advantageously steel housing and a plurality of discharge electrodes and collecting electrodes arranged in the housing. Each of the electrodes is made of a ceramic material and has an electrically conducting layer on at least one side thereof. The electrically conducting layer consists of a copper, nickel, bronze or iron-chromium-nickel alloy layer having a thickness of 0.1 to 2 mm. The ceramic material has a porosity of 25 to 90%, consists of fibers compacted with an inorganic binder and contains 30 to 70% by weight $Al_2O_3$, 15 to 50% by weight $SiO_2$ and 1 to 10% by weight of the inorganic binder. The discharge and collecting electrodes can be plates with a wall thickness of 5 to 100 mm. The discharge electrodes alternatively are tubular and have a wall thickness of 5 to 30 mm and a diameter of 30 to 100 mm.

7 Claims, 5 Drawing Sheets

APPARATUS FOR DEDUSTING A GAS AT HIGH TEMPERATURE

BACKGROUND OF THE INVENTION

The present invention relates to an apparatus of dedusting gases by electrostatic precipitation at temperatures above 400° C.

A process for dedusting gases by electrostatic precipitation at temperatures above 400° C. is known, in which the dust-laden hot gas is conducted through at least one passage defined by a tubular collecting electrode or by two plate-like collecting electrodes in which at least one discharge electrode is centrally disposed.

In the publication, "Heissgasentstaubung" by R. Pitt, Sonderlösungen der Lufteinhaltung, March 1989, L 4 to L 9, it has been pointed out that electrostatic precipitators have been satisfactory components of power plants, if the exhaust gases are at standard temperatures. It is also apparent from that publication that the degree of separation of dust from the gases under conditions which are otherwise equal increases as the temperature of the gases increases, because the viscosity and the volume flow rate of the gas increase with temperature. According to this publication it is not desirable to increase the collecting surface area to compensate for a rise in temperature, because a precipitator with this increased collecting surface area would have a larger size and thus would be more expensive and there would be a higher temperature drop. For this reason it is proposed in this publication to increase the electric field strength at higher operating temperatures, if this is possible without a flashover. The permissible field strength is favorably influenced by a higher gas pressure and the resulting higher gas density. At higher operating temperatures dust must be retained on the collection electrode and compacted to a sufficiently thick layer for the cleaning of the collecting electrode.

It has been found that in operation of known electrostatic precipitators, such as have been described in Ullmanns' Encyklopädie der technischen Chemie, 4th Edition, Volume 2, pp. 240 to 247, considerable difficulties arise in the case of normal gas pressures, if the operating temperature exceeds 400° C. Approximately at that temperature limit the current-voltage characteristic exhibits an unfavorable change unless the gas pressure is increased to 3 to 5 bars. The separation efficiency also is reduced, because the differential thermal expansions of different materials result in electrode spacing changes and, as a result, in disturbances of the electric field. Besides the materials used result in strength problems.

SUMMARY OF THE INVENTION

It is therefore an object of the present invention to provide an apparatus for dedusting gases at high temperatures by electrostatic precipitation which is reliable and has a comparatively high efficiency.

It is another object of the present invention to provide an apparatus for dedusting gases at high temperatures by electrostatic precipitation which requires maintenance comparatively infrequently and permits the collected dust to be discharged by simple means.

These objects and others, which will be made more apparent hereinafter, are attained in an apparatus for dedusting a gas by passing a gas containing dust at temperatures above 400° C. through at least one passage in an electrostatic precipitator. The passage is defined by a tubular collecting electrode or by two plate-like collecting electrodes in which at least one discharge electrode is centrally disposed.

According to the invention, the apparatus for dedusting a gas by electrostatic precipitation includes a housing and a plurality of discharge electrodes and collecting electrodes arranged in the housing. The electrodes are each made of a ceramic material and each of them has an electrically conducting layer on at least one side thereof. The electrically conducting layer comprises a copper, nickel, bronze or a iron-chromium-nickel alloy layer. The discharge electrodes can be tubular or plate-like.

In a process performed in the apparatus according to the invention the dedusting takes place at temperatures from 500° to 1000° C. A reliable operation of the electrostatic precipitator is obtained at these temperatures with a particularly effective dedusting.

Surprisingly it has been found that comparatively large currents can be produced at relatively low precipitator voltages at comparatively high temperatures, which is promoted by use of tubular or plate-like discharge electrodes. Because at temperatures up to 300° C. a successful electrostatic precipitation must be performed with discharge electrodes having only a comparatively small area (corona wires, corona points), it is surprising to those skilled in the art that large-area discharge electrodes can be used at higher temperatures. It is believed that by using comparatively large-area discharge electrodes in accordance with the invention the thermally induced emission of electrons is promoted and the formation of a corona is suppressed. It has also been found that appreciable quantities of dust are deposited on the comparatively large-area discharge electrodes. This does not prevent the establishment of an electric field so that the undesirable reverse corona effects occurring at temperatures up to 300° C. have not been observed at higher temperatures and where the large-area discharge electrodes were used in accordance with the invention. Because the formation of a corona is suppressed in the process in accordance with the invention, the risk of flashovers is drastically reduced so that the conditions during the electrostatic precipitation can be much more easily controlled and the influence of the gas pressure during the electrostatic precipitation is suppressed. The process in accordance with the invention may be carried out under normal pressure and under super-atmospheric pressure. Because the tubular or plate-like collecting electrodes consist of ceramic material and are provided with an electrically conductive layer of metal or alloy, the collecting electrodes are dimensionally stable at high temperatures and, above all, high temperatures do not cause the plate-like ceramic material to become distorted and the electrically conductive layers do not detach from the plates or tubes.

In one particularly advantageous preferred embodiment of the apparatus, the discharge electrodes are tubular, made of steel and have a wall thickness from 0.5 to 2 mm and an outer diameter from 1 to 80 mm, preferably from 25 to 80 mm. Alternatively, the discharge electrodes can be tubular, made of ceramic material and provided on the outside with an electrically conductive layer made of metal or alloy. In both embodiments, comparatively strong currents are generated at relatively low precipitator voltages and dust deposited on the discharge electrodes does not change the electric field.

Also according to the invention the plate-like discharge electrodes are used in a plate-type electrostatic precipitator and provided on both sides with electrically conductive layers of metal or alloy. These discharge electrodes are particularly satisfactory at operating temperature in excess of 600°, because they provide a highly uniform electric field, which is not disturbed, even by dust deposits.

In accordance with the invention the electrically conductive layer consists of copper, nickel, bronze or an iron-chromium-nickel alloy and is 0.1 to 2 mm in thickness. Such layers have excellent electrical conductivity and can be applied to the ceramic material, e.g., by flame spraying. They do not detach from the ceramic material, even at high temperatures, but the dust deposited on the electrically conductive layer is detached comparatively easily in the form of agglomerates.

The process in accordance with the invention is particularly advantageous, when the ceramic material has a porosity from 25 to 90%, because the collecting and discharge electrodes have a very low weight if porous ceramic materials are used. This has a favorable influence on the dimensional stability of the electrodes at high temperatures.

Also according to the invention the ceramic material comprises fibers which have been compacted with an inorganic binder to form a felt, and the ceramic material contains 30 to 70% by weight $Al_2O_3$, 15 to 50% by weight $SiO_2$ and 1 to 10% by weight of an inorganic binder. This material must be dimensionally stable, even during a comparatively long-time operation at temperatures of 1000° C., and has a low specific gravity. In particular, the electrically conductive layers applied to such material have an extremely high bond strength so that the coated plate-like material can easily be formed into large electrodes, which have provided excellently satisfactory during continuous operation.

According to an additional feature of the invention the collecting electrodes and discharge electrodes are plate-like i.e. each electrode is a plate, and has a thickness from 5 to 100 mm because such plates have desirable mechanical properties and can be process further without difficulty. In accordance with another feature of the invention the discharge electrodes are tubular and made of ceramic material and have a wall thickness from 5 to 30 mm and an outer diameter from 20 to 100 mm because discharge electrodes so designed establish a very stable electric field at high temperatures.

In particularly advantageous embodiments of the process performed in the apparatus according to the invention, the process is carried out at an electrostatic precipitator operating temperature of 600° C. with a precipitator voltage from 25 to 35 kV and also alternatively at an operating temperature of 600° C. and with a precipitator voltage from 8 to 15 kV at an operating temperature of 800° C. and a maximum precipitator current of about 2.5 $mA/cm^2$. It is particularly surprising that the process can be performed, as a rule, without a need for cleaning the electrodes, because the dust on the electrodes automatically detaches after a certain time from the electrodes in the form of agglomerates, which are then collected in the dust bin and discharged by appropriate means in a known way. Only in rare cases is it necessary to clean the electrodes by a vibration with infrasonics, e.g., at 40 Hertz.

The apparatus according to one embodiment of the invention consists of a tube-type electrostatic precipitator in which the flow of gases is vertical. This electrostatic precipitator has a housing containing a plurality of vertical tubular collecting electrodes, each of which contains a centrally disposed, axially extending tubular discharge electrode. The bottom part of the housing consists of a dust bin. The tubular collecting electrodes are made of ceramic material and on their inside surface facing the associated discharge electrode are provided with an electrically conductive layer of metal and/or alloy. The tubular discharge electrodes consist either of steel or of ceramic material and the ceramic discharge electrodes are provided on the outside with an electrically conductive layer of metal or alloy. Electrostatic precipitators with vertical flow are known per se.

The apparatus according to another embodiment of the invention consists of an electrostatic precipitator in which the flow of gases is horizontal. This electrostatic precipitator with horizontal flow has a housing whose lower part is a dust bin; at least two plate-like collecting electrodes, which are made of ceramic material and provided on both sides with electrically conductive layers of metal or alloy, which extend vertically and in the direction of flow of gas and which are parallel to each other; and at least one vertically extending steel or ceramic tubular discharge electrode centrally disposed between two collecting electrodes, the ceramic discharge electrodes being provided on the outside with an electrically conductive layer of metal or alloy. Plate-type electrostatic precipitators with horizontal flow are known per se.

The apparatus according to an additional embodiment of the invention, similar to the above apparatus, is an electrostatic precipitator with horizontal flow having a housing whose lower part is a dust bin; at least two plate-like collecting electrodes, which are made of ceramic material and provided on both sides with electrically conductive layers of metal or alloy, which extend vertically and in the direction of flow of gas; and a vertically extending ceramic plate-like discharge electrode centrally disposed between two collecting electrodes, the ceramic discharge electrodes being provided on both sides with an electrically conductive layer of metal or alloy.

The apparatus according to the invention permits the above-described process according to the invention to be carried out reliably and with comparatively minor maintenance. The electrodes may be suspended and insulated by means known per se. The fact that electrode spacing may have a tolerance range of ±10% has proved particularly desirable.

In accordance with a preferred embodiment of the invention the electrostatic precipitator has a housing consisting of a steel shell and a refractory internal lining because this material is gas-tight and dimensionally stable, even at temperatures from 500° to 1000° C.

The apparatus according to the invention has proved satisfactory for collection of dust, particularly fly ash dusts, which have an average particle diameter from 0.1 to 25 micrometers. The dielectric constant of the collected dusts is between 1 and 10. In the apparatus according to the invention there is turbulent flow and gas velocity is between 0.5 and 3 m/sec.. If the apparatus is provided with tubular discharge electrodes, the latter is connected to the negative pole of the source of voltage. The housing of the apparatus consists of a steel shell and is internally provided with a refractory lining, if operating temperatures above 500° C. are employed. The dust bin of the apparatus is shielded from gas side currents. The apparatus obviously is provided with heat insulation to prevent a temperature drop in the electrostatic precipitator. The discharge electrodes are suspended so as to be insulated from ground. Neither the discharge electrodes nor the collecting electrodes are rapped. In some cases infrasonic vibration is used to clean the collecting electrodes. The apparatus according to the invention may be composed of a plurality of precipitation fields. It is not necessary to heat the insulators provided on the discharge electrodes, since a purging of the insulators with gas has proved satisfactory in some cases.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
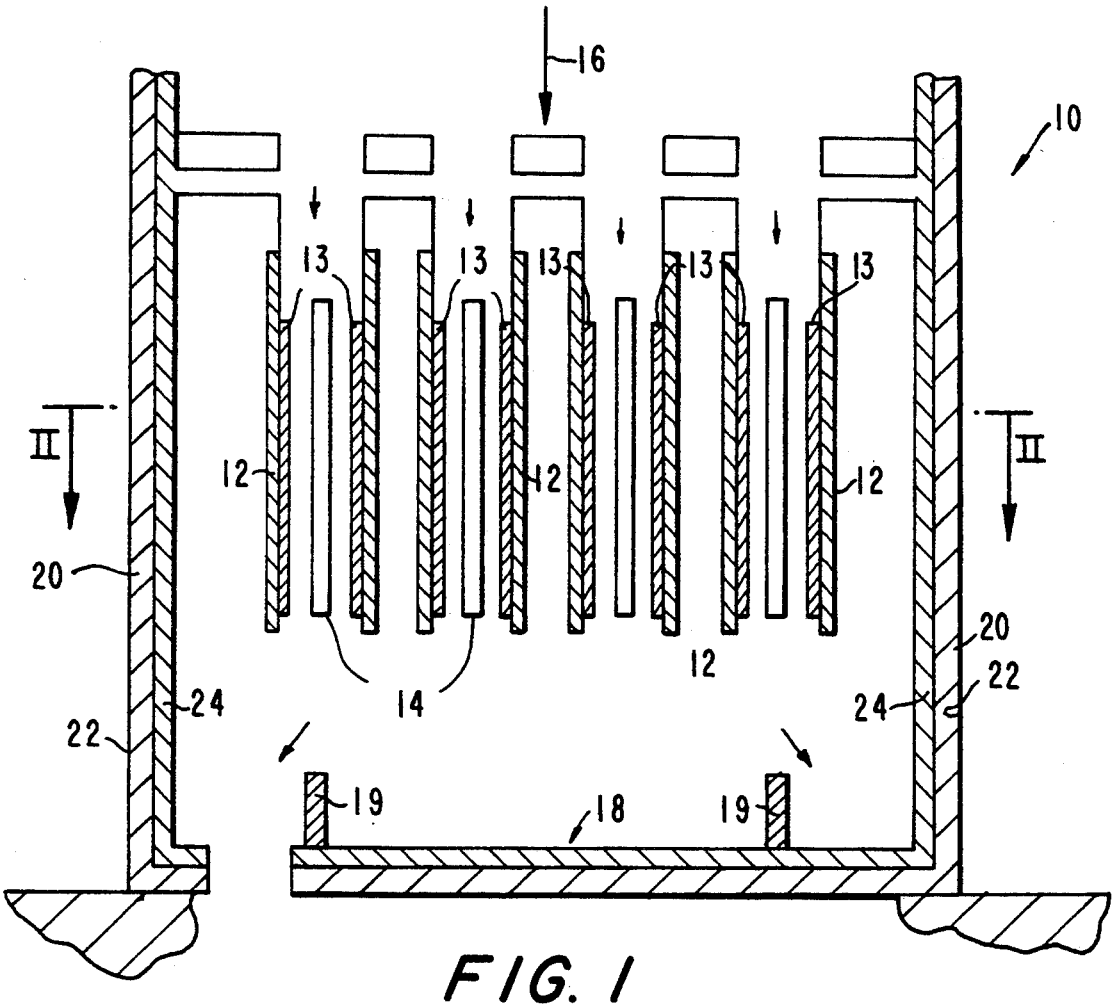
FIG. 1 is a vertical cross-sectional view of one embodiment of an electrostatic precipitator according to the invention in which the gas flow is vertical.
Figure 2:
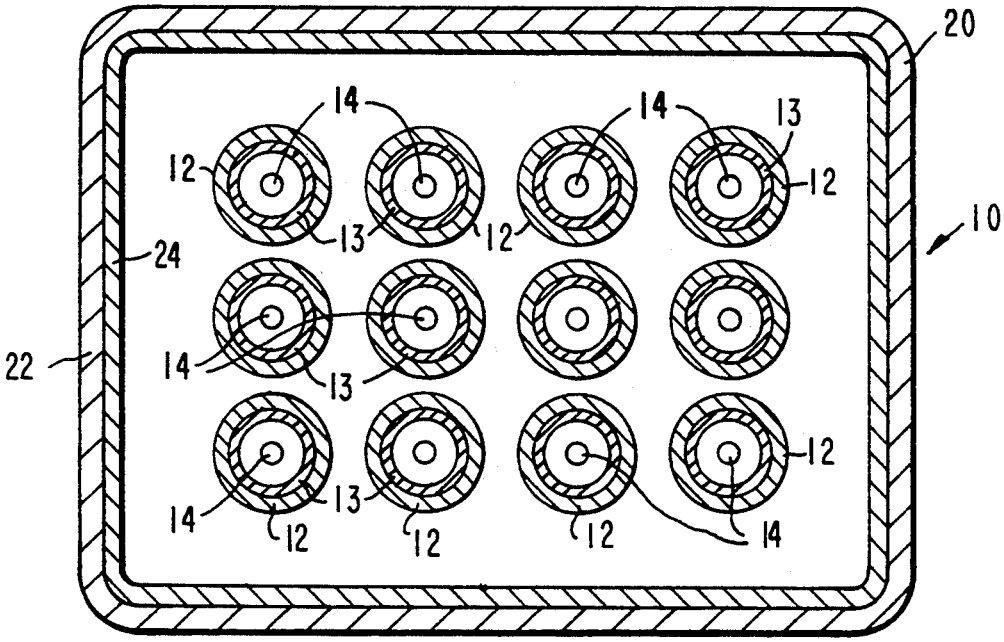
FIG. 2 is a horizontal cross-sectional view through the apparatus shown in FIG. 1.

The apparatus shown in FIGS. 1 and 2 consists of a tube-type electrostatic precipitator 10 in which the flow direction 16 of gases to be dedusted is vertical. This electrostatic precipitator 10 has a housing 20 containing a plurality of vertical tubular collecting electrodes 12, each of which contains a centrally disposed, axially extending tubular discharge electrode 14 located centrally in its associated tubular collecting electrode. The bottom part 18 of the housing 20 comprises a dust bin. The tubular collecting electrodes 12 are made of ceramic material and on their inside or interior surface facing the associated discharge electrode 14 are provided with an electrically conductive layer 13 of metal and/or alloy, from 0.1 to 2 mm of copper, particularly 0.3 mm. The tubular discharge electrodes 12 consist either of steel or of ceramic material and the ceramic discharge electrodes 14 are provided with an exterior electrically conductive layer of metal or alloy, e.g. from 0.1 to 2 mm of copper, particularly 0.3 mm.

Figure 3:
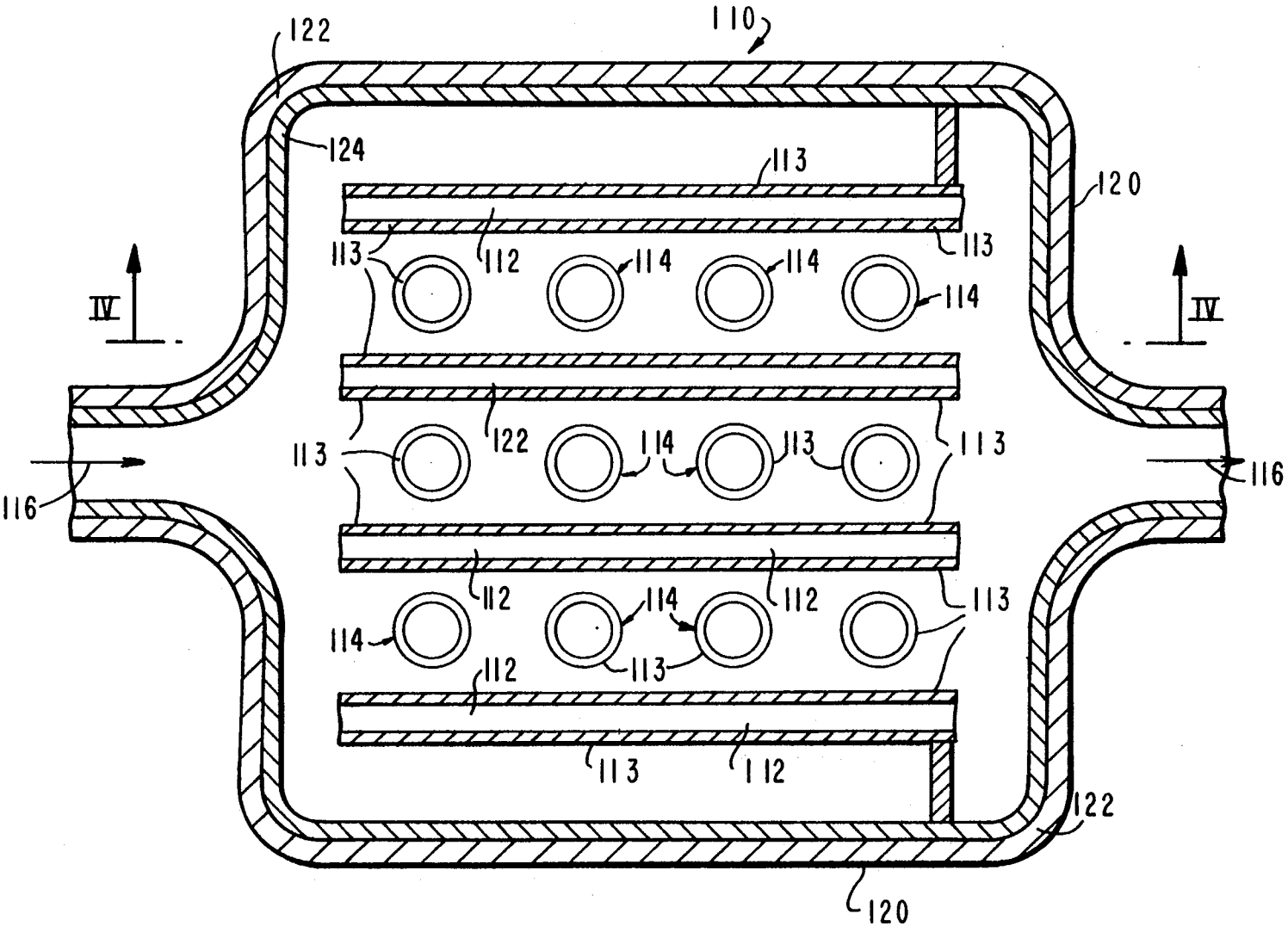
FIG. 3 is a horizontal cross-sectional view of another embodiment of an electrostatic precipitator according to the invention in which gas flow is horizontal.
Figure 4:
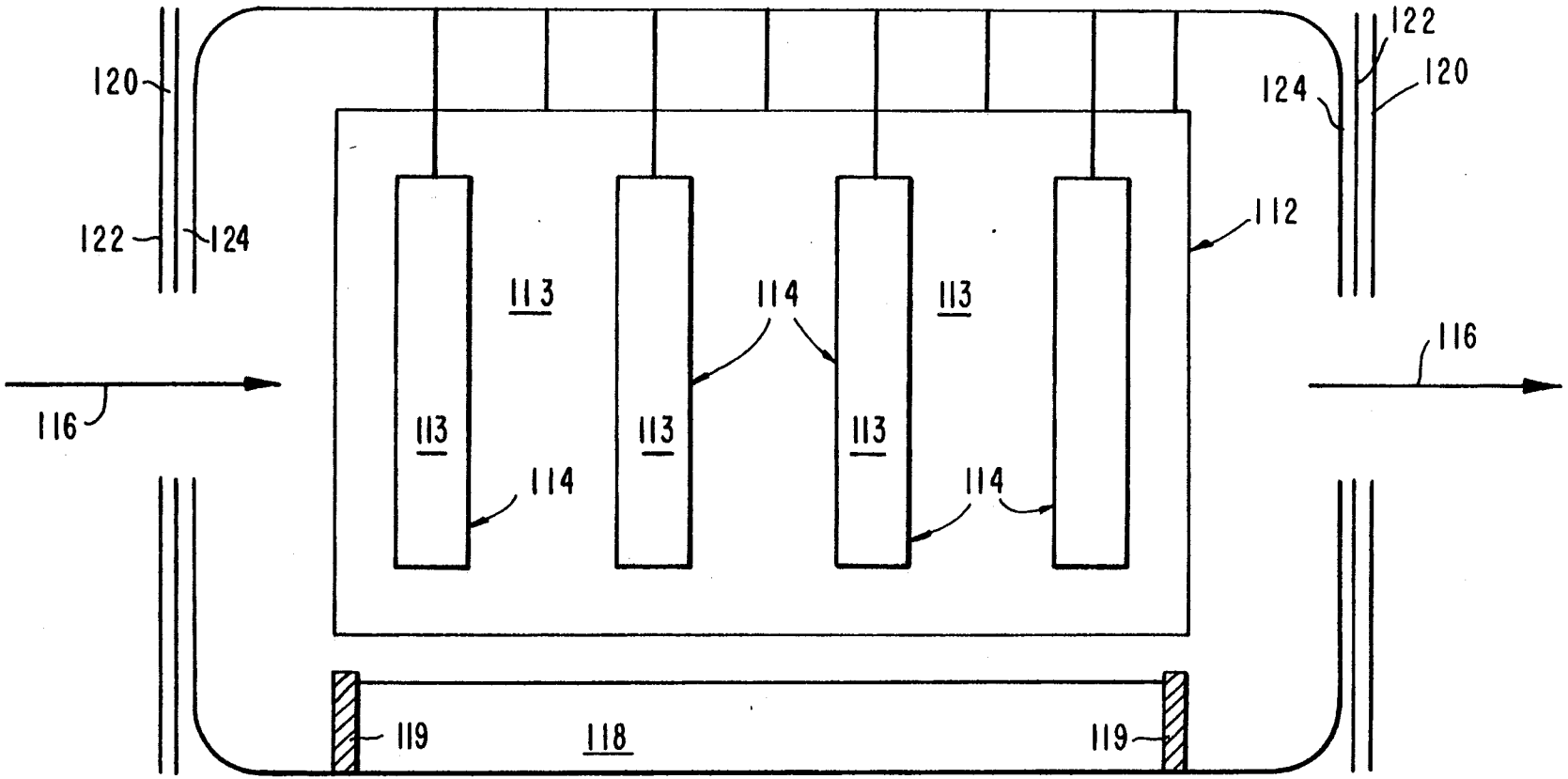
FIG. 4 is a vertical cross-sectional view through the apparatus shown in FIG. 3.

Another apparatus shown in FIGS. 3 and 4 according to the invention consists of an electrostatic precipitator 110 in which the flow direction 116 of gases is horizontal. This electrostatic precipitator 110 with horizontal flow has a housing 120 whose lower part 118 comprises a dust bin; at least two plate-like collecting electrodes 112, which are made of ceramic material and provided on both sides with electrically conductive layers 113 of metal or alloy,, e.g. from 0.1 to 2 mm of copper, which extend vertically and in the direction 116 of flow of gas and which are parallel to each other; and at least one vertically extending steel or ceramic tubular discharge electrode 114 centrally disposed between two collecting electrodes 112, the ceramic discharge electrodes 114 being provided on the outside with an electrically conductive layer of metal or alloy, e.g. from 0.1 to 2 mm of copper, particularly 0.3 mm.

When the tubular discharge electrodes are steel they have a wall thickness from 0.5 to 2 mm, an outer diameter from 1 to 80 mm, preferably from 25 to 80 mm, advantageously 40 mm. When the tubular discharge electrodes are made of ceramic material they have a wall thickness from 5 to 30 mm,e.g. 10 mm, and an outer diameter from 30 to 100 mm, e.g. 40 mm.

Figure 5:
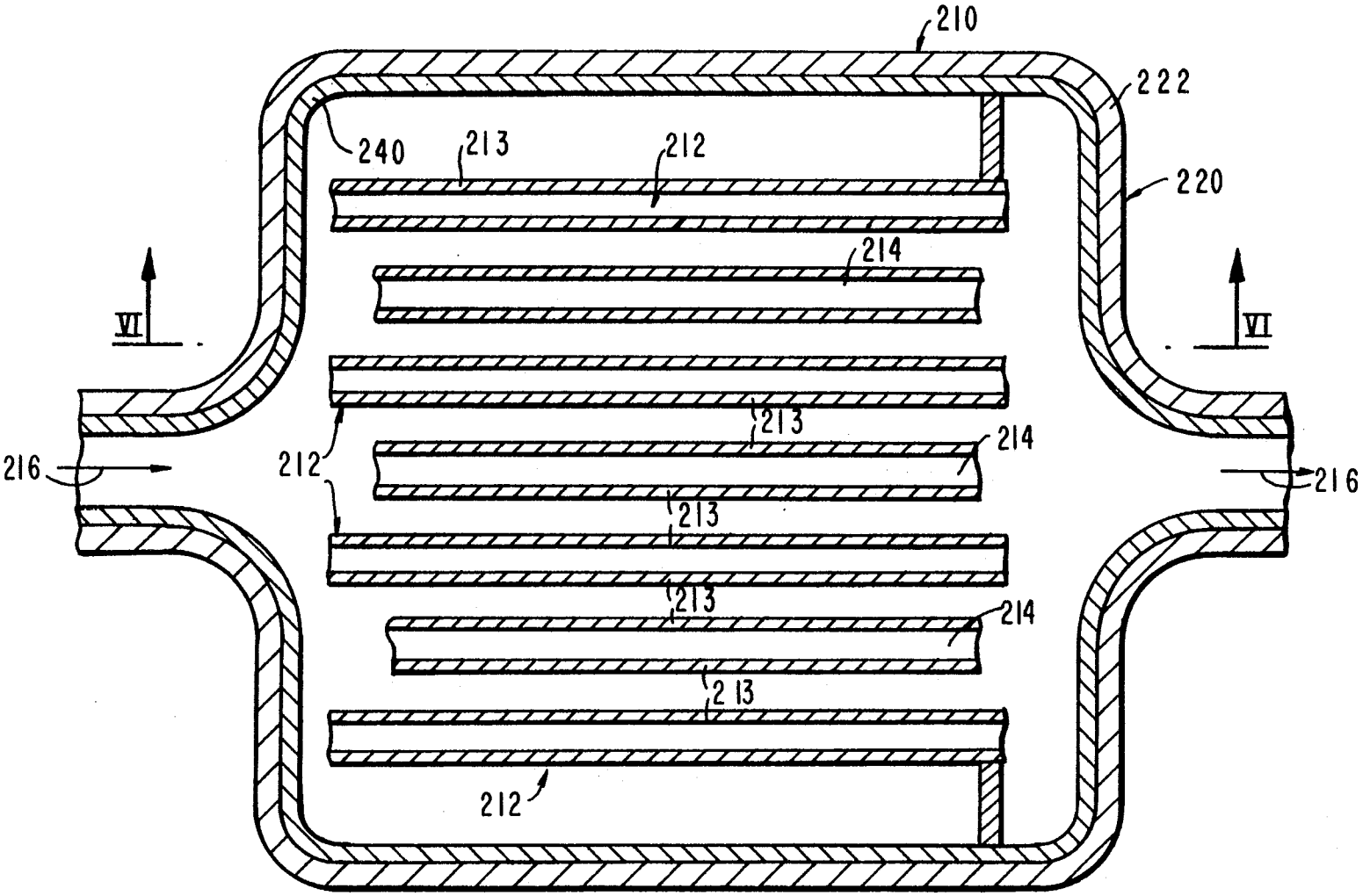
FIG. 5 is a horizontal cross-sectional view through an additional embodiment of an electrostatic precipitator according to the invention.
Figure 6:
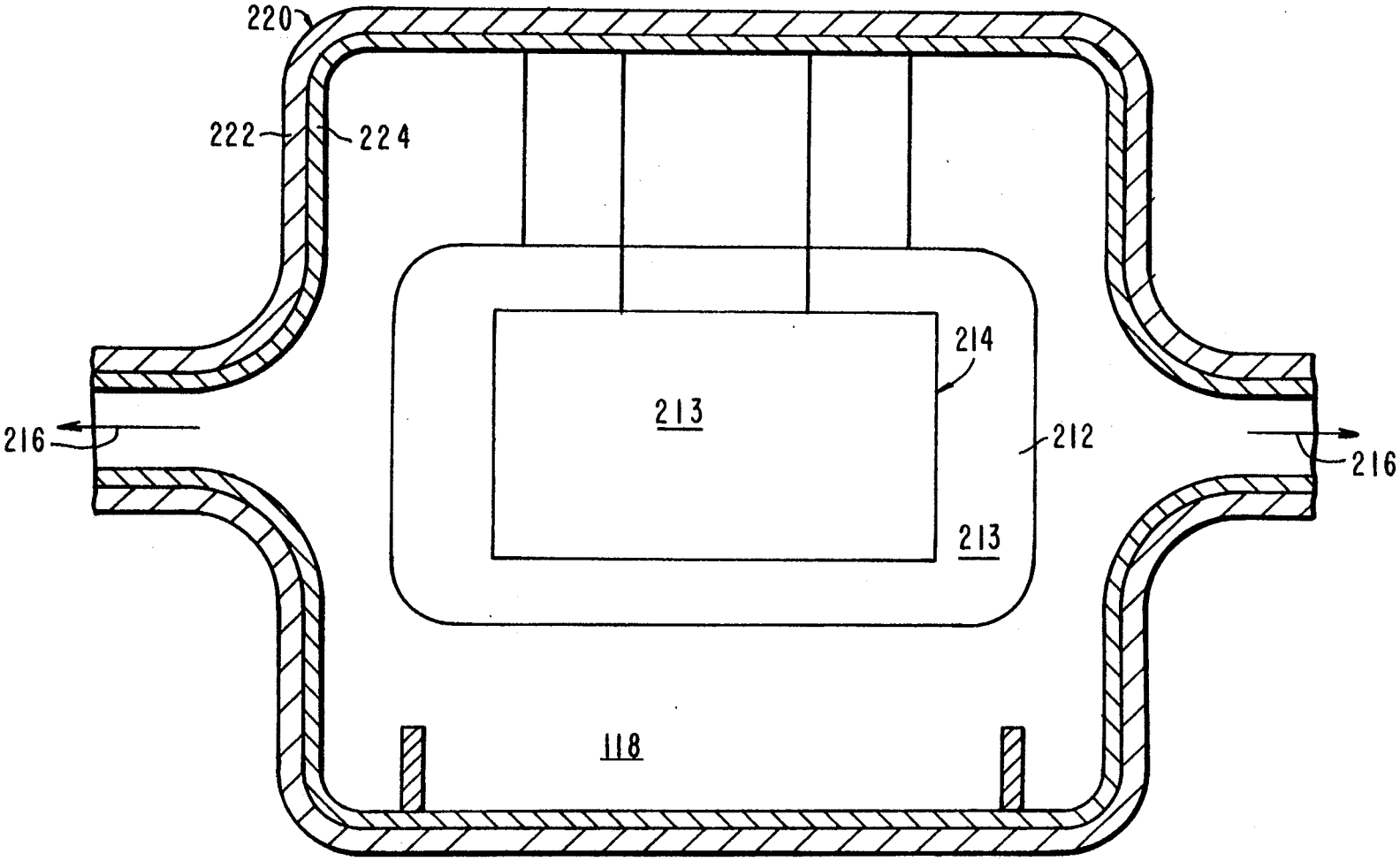
FIG. 6 is a vertical cross-sectional view through the embodiment shown in FIG. 5.

Another embodiment of the apparatus shown in FIGS. 5 and 6 according to the invention, similar to the above apparatus, is an electrostatic precipitator 210 with horizontal flow having a housing 220 whose lower part 218 is a dust bin; at least two plate-like collecting electrodes 212, which are made of ceramic material and provided on both sides with electrically conductive layers 213 of metal or alloy, e.g. from 0.1 to 2 mm of copper, particularly 0.3 mm, which extend vertically and in the direction 216 of flow of gas; and at least one vertically extending ceramic plate-like discharge electrode 214 centrally disposed between two collecting electrodes 212, the ceramic discharge electrodes being provided on both sides with an electrically conductive layer 213 of metal or alloy, e.g. from 0.1 to 2 mm of copper, particularly 0.3 mm. The thickness of the collecting and discharge electrodes advantageously is between 5 and 100 mm, in this case 10 mm.

The housing 20, 120, 220 can consist of a steel shell 22, 122, 222 and an interior refractory lining 24, 124, 224.

EXAMPLE

The results obtained for performing the process of the invention in a tube-type precipitator with vertical flow according to the embodiment of FIGS. 1 and 2 and in a plate-type precipitator with horizontal flow are shown in the following Table along with the dedusting conditions used.

TABLE

DUST CONTENT RESULTS FOR THE PROCESS OF THE INVENTION

| | Tube-type Precipitator | Plate-type Precipitator |
|---|---|---|
| Dust Content of Raw gas (g/sm$^2$) | 2.16 | 2.12 |
| Flue gas temperature (°C.) | 821 | 849 |
| Flue gas flow rate (sm$^3$/h) | 203 | 418 |
| Number of electric fields | 1 | 1 |
| Precipitator voltage (kV) | 13.7 | 14.8 |
| Dust Content of Pure Gas (g/sm$^3$) | 0.184 | 0.177 |
| Velocity of migration (m/s) | 0.069 | 0.84 |

Note that sm$^3$ = standard cubic meters

While the invention has been illustrated and embodied in an apparatus and process for dedusting gases at high temperatures by electrostatic precipitation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. Apparatus for dedusting a gas by electrostatic precipitation, said apparatus comprising:

a housing; and a plurality of discharge electrodes and collecting electrodes arranged in said housing, said electrodes being made of a ceramic material and having an electrically conducting layer on at least one side thereof, said electrically conducting layer comprising a material selected from the group consisting of copper, nickel, bronze and iron-chromium-nickel alloy and having a thickness of 0.1 to 2 mm, and wherein said ceramic material has a porosity of 25 to 90%, consists of fibers compacted with an inorganic binder and contains 30 to 70% by weight $Al_2O_3$, 15 to 50% by weight $SiO_2$ and 1 to 10% by weight of the inorganic binder.

2. Apparatus as defined in claim 1, wherein each of the discharge electrodes and the collecting electrodes is a plate and has a wall thickness of 5 to 100 mm.

3. Apparatus as defined in claim 1, wherein the discharge electrodes are tubular, have a wall thickness of 5 to 30 mm and a diameter of 30 to 100 mm.

4. Apparatus as defined in claim 1, wherein a lower portion of said housing is formed as a dust bin; and wherein said collecting electrodes and said discharge electrodes are tubular, said collecting electrodes are arranged vertically in said housing and each of said collecting electrodes contains one of said discharge electrodes extending centrally in an axial direction therein; and wherein each of the collecting electrodes has an inner surface facing said discharge electrode therein supporting one of said electrically conducting layers and each of said discharge electrodes has an outer surface supporting another of said electrically conducting layers.

5. Apparatus as defined in claim 1, wherein a lower portion of said housing is formed as a dust bin; and wherein each of said collecting electrodes is a plate and each of said discharge electrodes is tubular; and wherein at least two of said plates are arranged vertically and parallel to each other and extend in a flow direction of said gas in said housing and are provided with one of said electrically conducting layers on both sides thereof; and at least one of said tubular discharge electrodes is arranged vertically and centrally between two of said at least two plates and supports on an outer surface thereof another of said electrically conducting layers.

6. Apparatus as defined in claim 1, wherein a lower portion of said housing is formed as a dust bin; wherein each of said collecting electrodes and said discharge electrodes is a plate; and wherein at least two of said collecting electrodes are arranged vertically and parallel to each other and extend in a flow direction of said gas in said housing and are provided with one of said electrically conducting layers on both sides thereof; and one of said discharge electrodes is arranged vertically between two of said at least two collecting electrodes and has another of said electrically conducting layers provided on both sides thereof.

7. Apparatus as defined in claim 1, wherein said housing is made of steel and has a fire-resistant inner coating.

* * * * *